US008366466B2

(12) United States Patent
Hashimoto et al.

(10) Patent No.: US 8,366,466 B2
(45) Date of Patent: Feb. 5, 2013

(54) CONNECTOR

(75) Inventors: Youjirou Hashimoto, Yokkaichi (JP); Mitsunori Kitajima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/221,170

(22) Filed: Aug. 30, 2011

(65) Prior Publication Data

US 2012/0094523 A1 Apr. 19, 2012

(30) Foreign Application Priority Data

Oct. 15, 2010 (JP) ..... 2010-232853

(51) Int. Cl.
*H01R 24/00* (2011.01)

(52) U.S. Cl. ..... 439/206

(58) Field of Classification Search ..... 439/205, 439/198, 42, 206
See application file for complete search history.

(56) References Cited

U.S. PATENT DOCUMENTS

| | | | | |
|---|---|---|---|---|
| 4,066,312 | A * | 1/1978 | Faure | 439/42 |
| 5,511,987 | A * | 4/1996 | Shinchi | 439/205 |
| 5,685,729 | A * | 11/1997 | Reider et al. | 439/206 |
| 5,769,648 | A * | 6/1998 | Hayashi | 439/206 |
| 6,413,114 | B2 | 7/2002 | Fukamachi | |
| 6,511,337 | B1 * | 1/2003 | Fandrey et al. | 439/320 |
| 7,618,275 | B2 * | 11/2009 | Owen et al. | 439/206 |
| 7,726,982 | B2 * | 6/2010 | Ngo | 439/79 |
| 8,257,101 | B2 * | 9/2012 | Ichio | 439/206 |
| 2002/0168887 | A1 * | 11/2002 | Roscizewski et al. | 439/206 |

FOREIGN PATENT DOCUMENTS

| | | |
|---|---|---|
| DE | 3840678 | 2/1990 |
| DE | 19946825 | 2/2001 |
| JP | 10199613 | 7/1998 |
| JP | 2001283972 | 10/2001 |
| JP | 2005228554 | 8/2005 |

* cited by examiner

*Primary Examiner* — Neil Abrams
*Assistant Examiner* — Phuongchi Nguyen
(74) *Attorney, Agent, or Firm* — Gerald E. Hespos; Michael J. Porco

(57) ABSTRACT

An air hole (29) is formed to penetrate through a back wall (23) of a receptacle (22). Leading end portions (61) of male terminal fittings (60) are inserted into an inner portion (28) of a tube (27) and the air hole (29) communicates with the inner portion (28). If a female connector is connected in a posture inclined from a proper connecting posture, the tube (27) interferes with the female connector to prevent any further connecting operation. The tube (27) surrounds a plurality of male terminal fittings (60) together. A wall (31) for partially closing openings of the inner portion (28) is formed at a leading end portion of the tube (27).

9 Claims, 6 Drawing Sheets

CONNECTOR

BACKGROUND OF THE INVENTION

1. Field of the Invention

The invention relates to a connector.

2. Description of the Related Art

U.S. Pat. No. 6,413,114 discloses a connector with a receptacle for receiving a mating female connector. Male terminal fittings are mounted through a back wall of the receptacle and project into the receptacle. A tube projects from the back wall into the receptacle. The leading ends of the longer male terminal fittings are inserted in the tube.

An air hole may penetrate through the back wall to accommodate an escape of air during connection of two connectors thereby reducing an internal pressure when connecting two connectors and reducing a work load of an operator during a connecting operation. An entire ventilation capacity can be expanded if the air hole communicates with an inner portion of the tube. However, such a construction may allow external matter to intrude into the tube through an opening at a leading end of the tube and the external matter may block the air hole to impair a ventilation function.

The invention was developed in view of the above situation and an object thereof is to prevent an air hole from being blocked by an external matter.

SUMMARY OF THE INVENTION

The invention relates to a connector with a receptacle for receiving a mating connector. Terminal fittings are mounted through a back wall of the receptacle and are arranged so that leading ends thereof project into the receptacle. A tube projects into the receptacle from the back wall and at least one air hole penetrates through the back wall of the receptacle. The leading ends of the terminal fittings are inserted into an inner portion of the tube and the air hole communicates with the inner portion. The tube surrounds the terminal fittings together. A wall for partially closing an opening of the tube is formed at or near a leading end of the tube.

The tube surrounds the terminal fittings. Thus, dimensions of an opening inside the tube tend to be large and external matter may intrude into the tube. However, the wall is formed near the leading end of the tube and partially closes the opening. Thus, external matter is less likely to intrude into the tube. As a result, the air hole that communicates with the interior of the tube is not likely to be blocked by external matter.

The wall is arranged at a position substantially facing the air hole in a penetration direction of the air hole. Thus, the air hole is less likely to be blocked by external matter.

The leading end of each male terminal fitting has a substantially rectangular cross section. At least two surfaces of the leading end portion of each male terminal fitting are separated from the inner surface of the tube. Thus, an increase in insertion resistance of the male terminal fitting being inserted into the tube is avoided.

A projecting distance of the tubular portion preferably is set to be longer than the length of the leading end portion of the terminal fitting.

The back wall preferably comprises one or more terminal insertion holes for receiving corresponding terminal fittings. The terminal insertion holes include one or more expanded spaces that communicate with the air hole.

The leading ends of the terminal fittings and the wall preferably are positioned so as not to overlap each other in forward and backward directions.

The wall preferably has substantially the same rectangular cross sectional shape as the air hole.

The wall preferably is positioned to at least partly overlap with the air hole in the width direction.

The connector may further comprise an alignment plate mounted to a housing of the connector and comprising positioning holes to position the terminal fittings.

Rear end portions of the respective terminal fittings preferably are bent into slack portions located between the rear surface of the back wall and the front surface of the alignment plate.

These and other objects, features and advantages of the invention will become more apparent upon reading the following detailed description of preferred embodiments and accompanying drawings.

DETAILED DESCRIPTION OF THE PREFERRED EMBODIMENTS

A connector 10 according to the invention is identified generally by the numeral 10 in FIGS. 1 to 6. The connector 10 includes a housing 20 and male terminal fittings 60.

Figure 1:
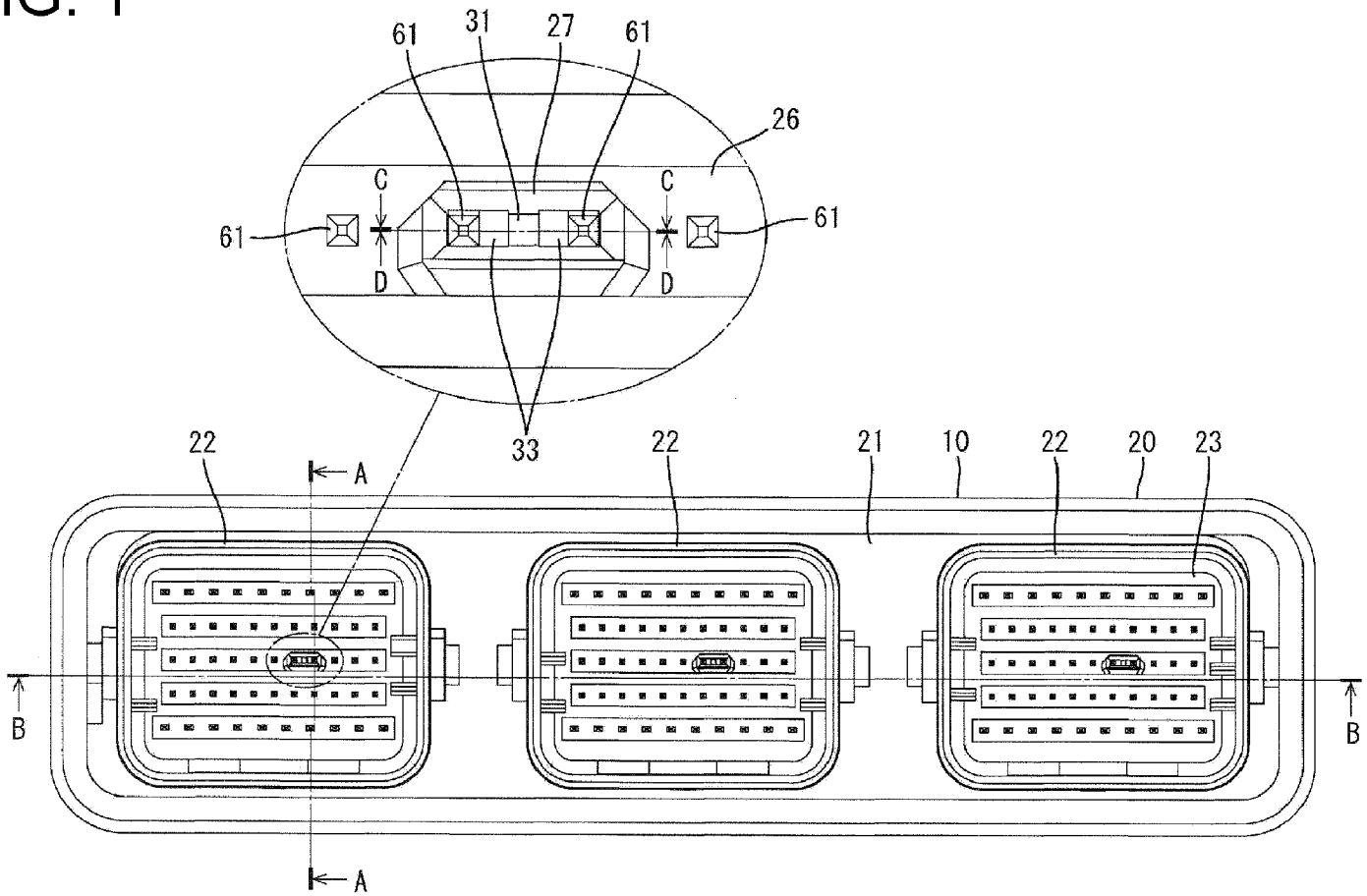
FIG. 1 is a front view of a connector according to the invention.

The housing 20 is made e.g. of synthetic resin and includes a substantially rectangular back wall 21 that is long and narrow in a width direction. Three substantially rectangular tubular receptacles 22 are arranged substantially side by side in the width direction and open forward from the back wall 21, as shown in FIG. 1. Unillustrated mating female connectors can fit into the respective receptacles 22 from the front.

Figure 2:
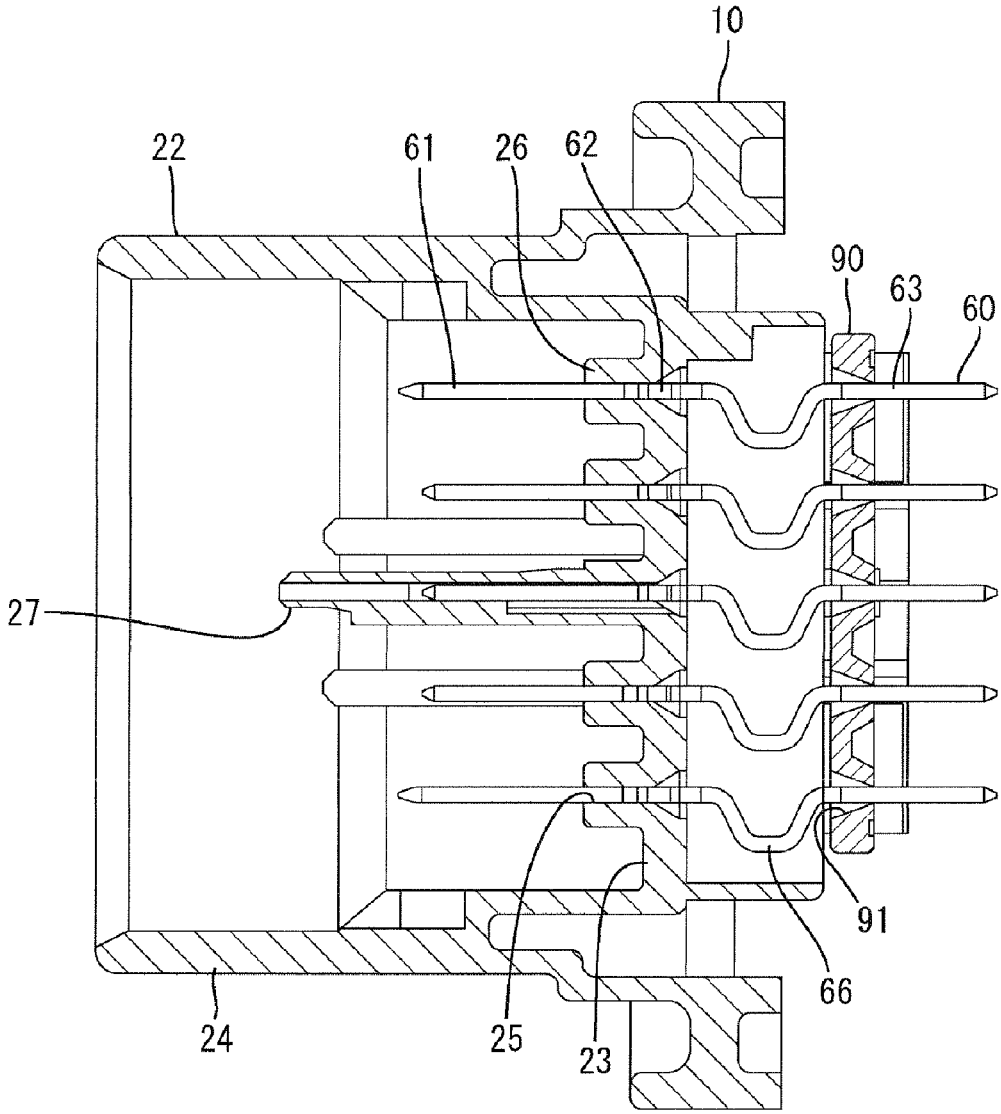
FIG. 2 is a section along A-A of FIG. 1.
Figure 3:
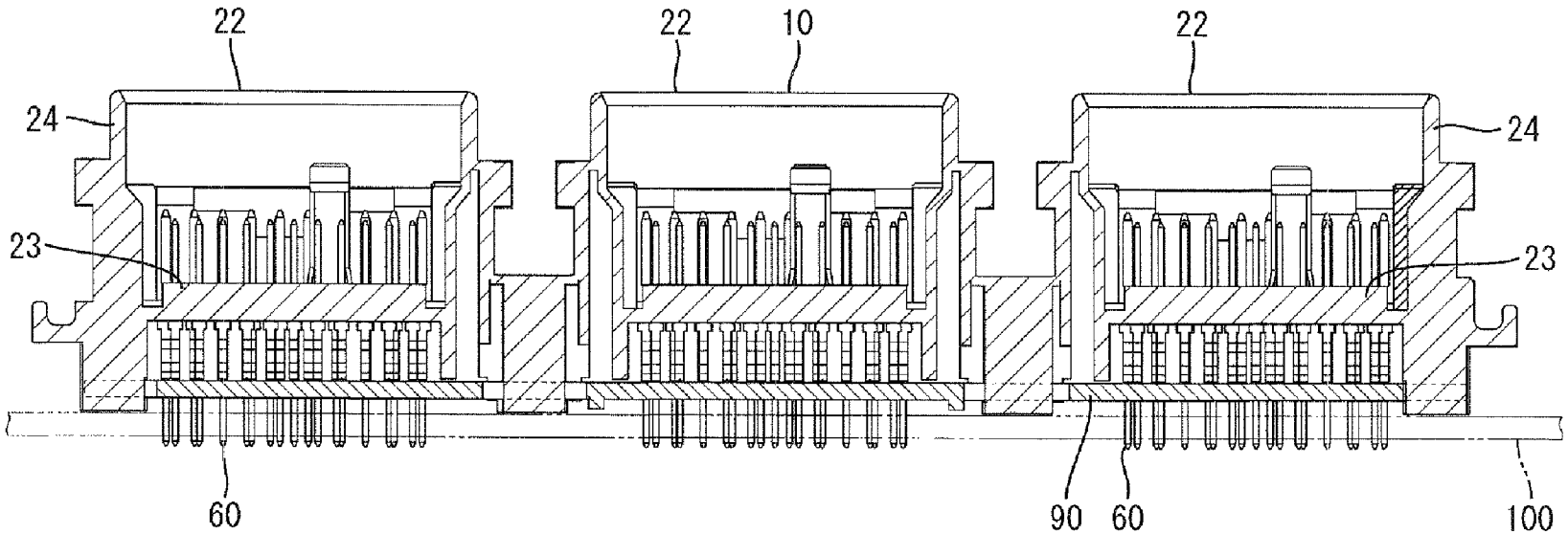
FIG. 3 is a section along B-B of FIG. 1.

As shown in FIG. 3, each receptacle 22 includes a back wall 23 and a substantially rectangular tubular peripheral wall 24 that projects forward from the back wall 23. Terminal insertion holes 25 penetrate through the back wall 23 and are arranged in columns in the width direction and rows in a height direction, as shown in FIG. 2. Further, towers 26 arranged in rows in the height direction and project from the front surface of the back wall 23. Each tower 26 defines long and narrow plate aligned in the width direction and a row of the terminal insertion holes 25 is formed in each tower.

The male terminal fittings 60 are inserted into the respective terminal insertion holes 25 from behind. Each male terminal fitting 60 is made of an electrically conductive metal and defines a rectangular bar that is long and narrow in forward and backward directions. More specifically, each male terminal fitting 60 has a leading end 61 that projects forward from the tower 26 and into the receptacle 22, an intermediate portion 62 mounted in the terminal insertion hole 25 and a rear end portion 63 that projects out from the rear surface of the back wall 23. The male terminal fittings 60 in the highest and lowest rows are longer than the other male terminal fittings 60.

Figure 4:
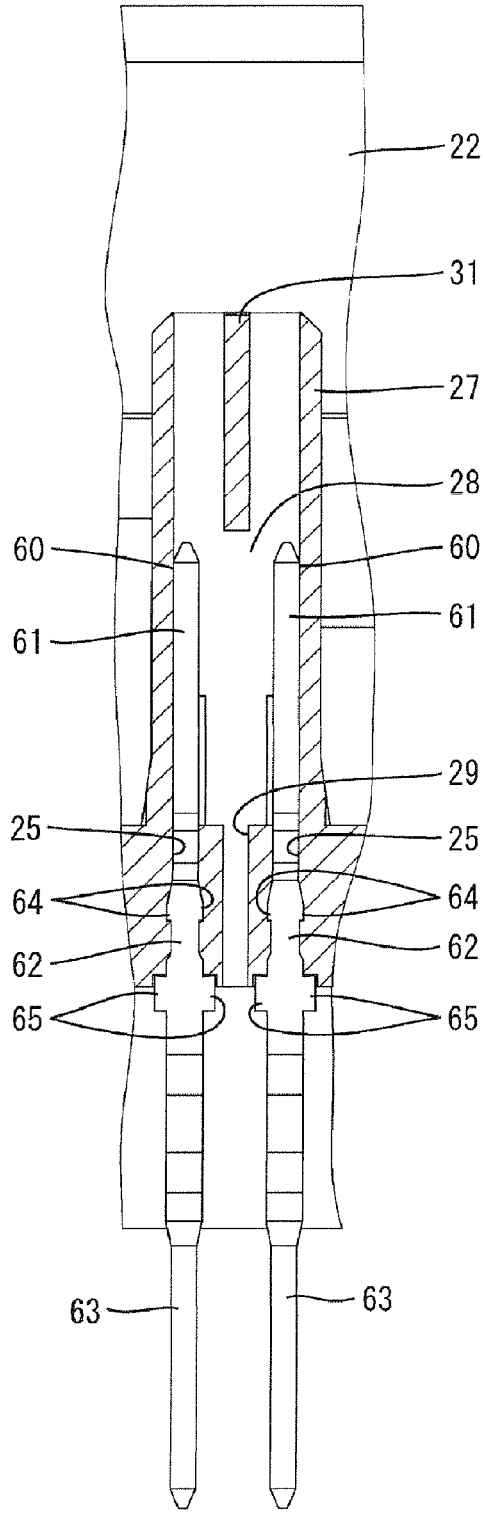
FIG. 4 is a section along C-C of FIG. 1.
Figure 5:
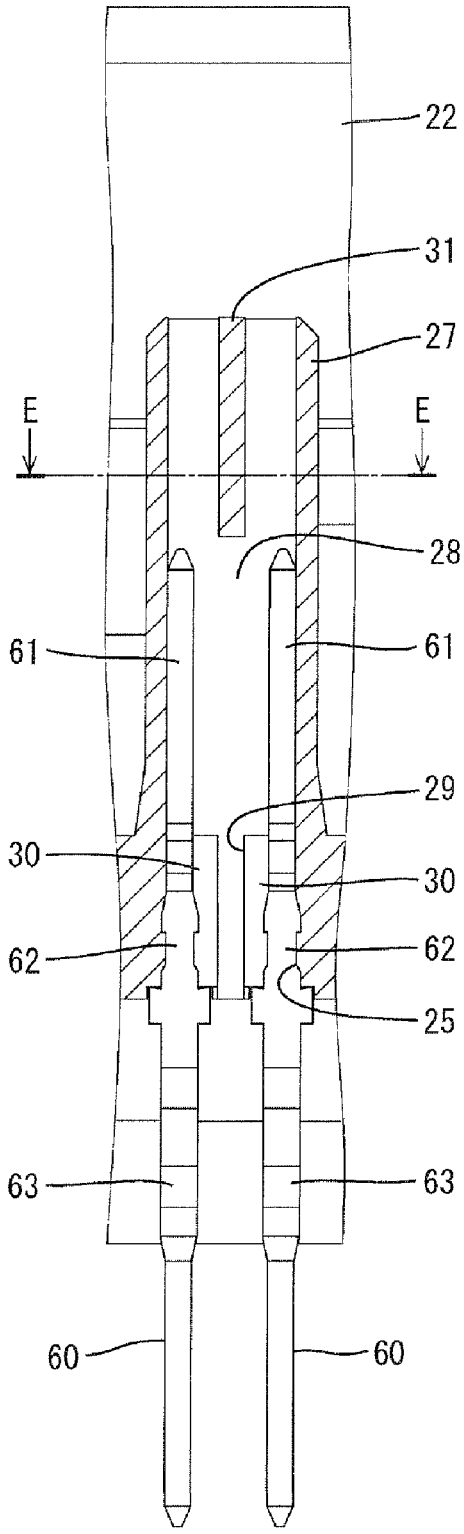
FIG. 5 is a section along D-D of FIG. 1.
Figure 6:
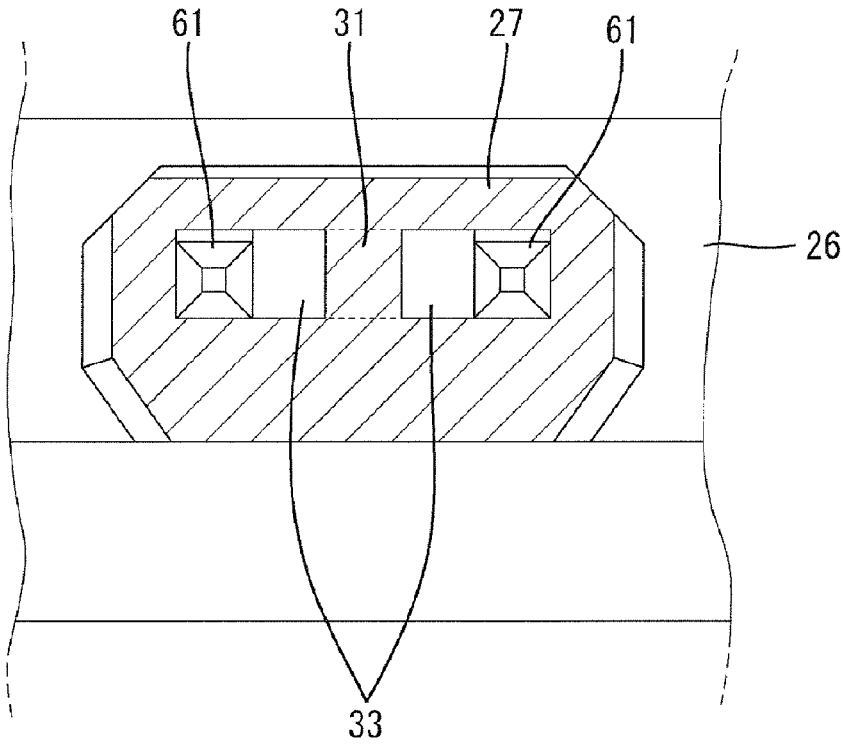
FIG. 6 is a section along E-E of FIG. 5.

As shown in FIG. 4, locking pieces 64 project at the opposite widthwise side edges of the intermediate portion 62 of each male terminal fitting 60. Contact pieces 65 project at the widthwise side edges of the intermediate portion 62 of the male terminal fitting 60 at positions behind the locking pieces 64. When the male terminal fitting 60 is mounted, the locking pieces 64 bite in or engage the inner surface of the terminal insertion hole 25 to hold the male terminal fitting 60 in the receptacle 22 and the contact pieces 65 rest in contact with the opening edge at the rear end of the terminal insertion hole 25 to prevent any further insertion of the male terminal fitting 60.

An alignment plate 90 is mounted to the housing 20 from behind and is formed with positioning holes 91 that face the respective terminal insertion holes 25.

Rear end portions 63 of the respective male terminal fittings 60 are inserted into the respective positioning holes 91. Further, the rear end portions 63 of the male terminal fittings 60 are bent into substantially V- or S- or U-shaped slack portions 66 that are between the rear surface of the back wall 23 and the front surface of the alignment plate 90. Parts of the rear end portions 63 of the male terminal fittings 60 projecting back from the respective positioning holes 91 are inserted into through holes (not shown) of a printed circuit board 100 and are fixed or connected thereto by soldering or the like.

One tube 27 projects from the front surface of the one tower 26 on the back wall 23 of each receptacle 22. As shown in FIG. 1, the tube 27 is flat in cross section and is in a substantially central part of the receptacle 22 in the height direction and slightly shifted toward one side from a central part in the width direction.

An inner portion 28 of the tube 27 is narrow and long in the width direction. The leading end portions 61 of two of the male terminal fittings 60 arranged side by side in the width direction are inserted into the inner portion 28 of the tube 27. More particularly, a peripheral wall 24 of the tube 27 surrounds the two male terminal fittings 60 together. In this case, the projecting height of the tube 27 exceeds the length of the leading end portion 61 of the male terminal fitting 60. The leading ends 61 of the two male terminal fittings 60 are arranged along the opposite widthwise inner side surfaces of the tube 27 so that one surface of each of the two male terminal fittings 60 is in contact with one widthwise inner surface of the tube 27 and at least two other surfaces of the two male terminal fittings 60 are separated from inner surfaces of the tube 27.

At least one air hole 29 penetrates through the back wall 23 of each receptacle 22 in forward and backward directions and preferably has a rectangular cross sectional shape. The air hole 29 is at a position substantially corresponding to a widthwise central part of the tube 27 and is formed in the back end surface of the tube 27 to communicate with the inner portion 28 of the tube 27. Note that the terminal insertion holes 25 include expanded spaces 30 that communicate with the air hole 29.

A wall portion 31 is formed at a leading end of the tube 27 and partially closes a front opening 33 of the inner portion 28. The wall 31 is substantially in the widthwise center of the tube 27 and is connected at both ends to the inner surface of the tube 27. The wall 31 is long and narrow in forward and backward directions. The front end of the wall 31 is at substantially the same position as the leading end of the tube 27 and the rear end of the wall 31 is at a position slightly closer to the openings than the leading ends of the male terminal fittings 60 inserted into the inner portion 28 of the tube 27. Thus, the leading ends 61 of the male terminal fittings 60 and the wall 31 do not overlap in forward and backward directions.

The wall 31 substantially faces the air hole 29 in forward and backward directions and along a penetration direction of the air hole 29. Specifically, the wall 31 has substantially has the same rectangular cross sectional shape as the air hole 29 and is positioned to at least partly overlap with the air hole 29 in the width direction. When the connector 10 is viewed from front, the air hole 29 is hidden behind the wall 31. On the other hand, two front openings 33 of the tube 27 are arranged at opposite widthwise sides of the wall 31, and the leading ends of the male terminal fittings 60 can be seen from front through these front openings 33.

At the time of molding the connector 10, the air holes 29 are formed by pulling a mold back from the rear ends of the walls 31 and the opposite widthwise sides of the inner portions 28 of the tubes 27 are formed by pulling a mold forward from the rear ends of the tubes 27 (front ends of the towers 26).

A mating female connector may be inserted into the receptacle 22 in an inclined posture. However, the leading end of the tube 27 will interfere with the inclined female connector to prevent any further connection of the female connector so that the inclined female connector will not damage the leading ends 61 of the male terminal fittings 60. Furthermore, the wall 31 increases the rigidity of the leading end of the tube 27 and ensures that the female connector will not damage the leading end of the tube 27.

When the mating female connector is connected properly, an internal pressure is generated between the two connectors, but escapes to the outside through the inner portion 28 of the tube 27 and the air hole 29. Thus, an increase in connection resistance of the two connectors is avoided and a work load during a connecting operation is reduced.

If the opening dimensions of the inner portion 28 of the tube 27 are large, as in this embodiment, external matter may possibly intrude into the tube 27. However, the wall 31 partially closes the front openings 33 of the tube 27 and impedes the entrance of external matter into the inner portion 28 of the tube 27. Thus, the air hole 29 that communicates with the inner portion 28 of the tube 27 will not be closed by external matter.

The wall 31 is arranged at a position substantially facing the air hole 29 in the penetration direction of the air hole 29 for more reliably preventing external matter from blocking the air hole 29.

At least two surfaces of the leading end portion 61 of the male terminal fitting 60 are separated from inner surfaces of the tube 27 to prevent an increase in insertion resistance of the male terminal fitting 60 when mounting the male terminal fitting 60.

The invention is not limited to the above described and illustrated embodiment and the following embodiments also are included in the scope of the invention.

The leading end portions of three or more male terminal fittings may be inserted into the tube.

The rear end of the wall may be arranged at the same position as the leading ends of the male terminal fittings inserted into the tube. Further, the wall and the leading end portions of the male terminal fittings may be positioned to overlap each other in forward and backward directions.

The tube may surround a plurality of male terminal fittings together in the height direction or to surround a plurality of male terminal fittings together in the height direction and the width direction.

The invention is also applicable to wire-to-wire connectors without being limited to board connectors.

A hole may be formed in a part of the peripheral wall of the tube.

The invention is also applicable to female connectors and to connectors having just one receptacle.

What is claimed is:

1. A connector, comprising a receptacle for receiving a mating connector, the receptacle having a back wall, a tube projecting into the receptacle from the back wall, the tube having an inner portion, terminal insertion holes penetrating through the back wall and at least one air hole penetrating through the back wall at a position between the two of the terminal insertion holes and communicating with the inner portion of the tube, a wall formed at a leading end portion of the tube at a position substantially facing the air hole in a penetration direction of the air hole and partially closing an opening to the inner portion of the tube; and terminal fittings mounted through the back wall and having leading ends projecting into the receptacle, the leading end portion of one or more of the terminal fittings being in the inner portion of the tube so that the tube surrounds the one or more terminal fittings.

2. The connector of claim 1, wherein:

the leading end portion of each terminal fitting has a substantially rectangular cross section; and at least two surfaces of the leading end portion of each terminal fitting are separated from the inner surface of the tube.

3. The connector of claim 1, wherein a projecting distance of the tube exceeds the length of the leading end portion of the terminal fitting.

4. The connector of claim 1, wherein the terminal insertion holes including expanded spaces communicating with the air hole.

5. The connector of claim 1, wherein the leading ends of the terminal fittings and the wall are positioned so as not to overlap each other in forward and backward directions.

6. The connector of claim 1, wherein the wall has a rectangular cross sectional shape substantially conforming to a cross sectional shape of the air hole.

7. The connector of claim 1, wherein the wall is positioned to overlap with the air hole in the width direction.

8. The connector of claim 1, further comprising an alignment plate mounted to a housing of the connector and comprising positioning holes to position the respective terminal fittings.

9. The connector of claim 8, wherein one or more rear end portions of the respective terminal fittings are bent to define slack portions located between the rear surface of the back wall and the front surface of the alignment plate.

* * * * *